US008418697B2

(12) United States Patent
Ehling et al.

(10) Patent No.: US 8,418,697 B2
(45) Date of Patent: Apr. 16, 2013

(54) HIGH-PRESSURE FORMING PROCESS FOR TOBACCO MATERIAL

(75) Inventors: Uwe Werner Ehling, Goldkronach (DE); Dietmar Franke, Bayreuth (DE); Gerald Schmekel, Elmshorn (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 731 days.

(21) Appl. No.: 12/523,143

(22) PCT Filed: Dec. 12, 2007

(86) PCT No.: PCT/EP2007/010552

§ 371 (c)(1), (2), (4) Date: Feb. 16, 2010

(87) PCT Pub. No.: WO2008/086843

PCT Pub. Date: Jul. 24, 2008

(65) Prior Publication Data

US 2010/0139675 A1 Jun. 10, 2010

(30) Foreign Application Priority Data

Jan. 18, 2007 (DE) ..... 10 2007 002 687

(51) Int. Cl.
*A24B 3/18* (2006.01)

(52) U.S. Cl.
USPC ..... 131/299; 131/309; 131/300

(58) Field of Classification Search ..... None
See application file for complete search history.

(56) References Cited

U.S. PATENT DOCUMENTS

| | | | | |
|---|---|---|---|---|
| 3,792,010 | A * | 2/1974 | Wasserman et al. | 606/230 |
| 3,806,569 | A * | 4/1974 | Gallard et al. | 264/40.7 |
| 3,968,804 | A * | 7/1976 | Kelly et al. | 131/370 |
| 4,880,018 | A | 11/1989 | Graves | |

FOREIGN PATENT DOCUMENTS

| | | | |
|---|---|---|---|
| DE | 102004059388 | A1 | 6/2006 |
| EP | 0894594 | A2 | 2/1999 |
| EP | 1219186 | A2 | 7/2002 |
| EP | 1444905 | A2 | 8/2004 |
| WO | WO2006084624 | A1 | 8/2006 |

OTHER PUBLICATIONS

PCT International Search Report and Written Opinion.

* cited by examiner

*Primary Examiner* — Michael J Felton
(74) *Attorney, Agent, or Firm* — N W Poulsen

(57) ABSTRACT

The invention relates to a method of producing cut tobacco material, whereby a tobacco starting material is heated and brought to a first increased pressure in one method stage; whereby the tobacco material is pumped to a second increased pressure in the second method stage which is higher than the first increased pressure; and whereby the tobacco material, heated and placed under pressure, is expanded and fed through a forming tool (23). It further relates to a device for producing cut tobacco material comprising a heatable pressure chamber (1) with a tobacco material inlet, a tobacco material outlet and a conveying mechanism (5) for conveying the tobacco material from the inlet to the outlet and for increasing the pressure of the material to a first increased pressure, and with a forming tool (23) by means of which the tobacco material, heated and placed under pressure, is conveyed and expanded, and a mechanical pump (7) is integrated between the pressure chamber (1) and the forming tool (23) which pumps the tobacco material to a second increased pressure which is higher than the first increased pressure.

21 Claims, 6 Drawing Sheets

HIGH-PRESSURE FORMING PROCESS FOR TOBACCO MATERIAL

CLAIM FOR PRIORITY

Figure 1:
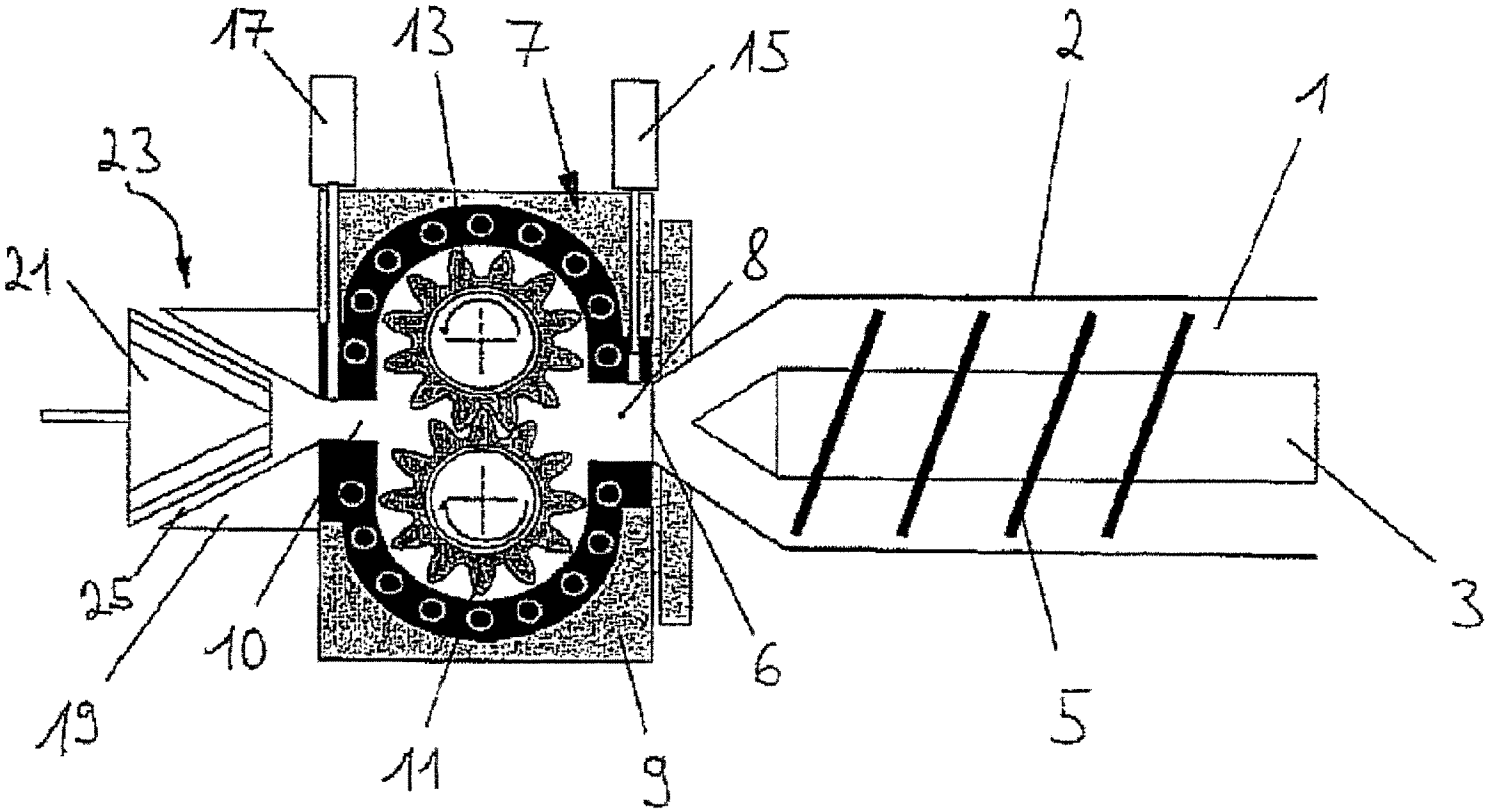

This application is a National Stage Entry entitled to and hereby claims priority under 35 U.S.C. §§ 365 and 371 corresponding to PCT Application No. PCT/EP2007/010552, titled, "High-pressure shaping process for tobacco material," filed Dec. 5, 2007, which in turn claims priority to German Application Ser. No. DE 102007002687.2, filed Jan. 18, 2007, all of which are hereby incorporated by reference.

This invention relates to a high pressure forming process for tobacco material. Specifically, it relates to the production of cut tobacco material or fibre-shaped tobacco material, which can be used as a product for manufacturing smoking articles.

When preparing the tobacco, i.e. during those preparation processes which take place prior to actual cigarette production and packaging, the most important tobacco materials, namely tobacco leaves and tobacco ribs, are subjected to several process steps before they can be used to produce smoking articles. The rib material used, as well as coarse or incompletely cut raw ribs (winnowings) are very difficult to process using standard means (cutters, shredders) and obtain an optimum result, in other words produce a cut tobacco material which can be used as smoking article material. Too many small pieces or dusts are created and/or lengthy intermediate storage periods are necessary.

Rib preparation processes which enable the ribs to be processed into tobacco film are disclosed in patent specifications DE 40 05 656 C2 and DE 43 25 497 A1, for example. Such tobacco film processes produce product with moderate to poor filling capacity and sensory properties. Patent specification DE 100 65 132 A1 discloses a method of producing agglomerates, whereby larger particle complexes are produced from the smallest tobacco particles. Binding agents must be used for this purpose and such a process is not suitable for processing coarser tobacco material (such as ribs or winnowings for example).

Patent specification DE 10 2004 059 388 A1 describes a process of reducing tobacco material to fibres, in particular from ribs or winnowing material. To this end, the tobacco starting material is heated and brought to an increased pressure and is so by means of a screw conveyor, at the outlet of which a shearing gap is disposed. The processing of the material as it leaves the shearing gap accompanied by flash evaporation results in a tobacco material reduced to fibres.

One objective of the invention is to propose a method of producing cut tobacco material, which delivers a better product quality than can be achieved by the methods known from the prior art. In particular, a tobacco material quality should be obtained which is immediately suitable for producing cigarettes by machine and in particular even corresponds to the demands made on a tobacco material used for self-rolled cigarettes. Due to a special feature, wear should also be minimised compared with devices known from the prior art.

This objective is achieved by the invention on the basis of a method as defined in claim 1 and a device as defined in claim 11. Preferred embodiments of the invention are defined in the dependent claims.

The tobacco starting material may primarily be a coarse tobacco material, in particular with a particle size of more than 2 mm. It may be a tobacco rib material or a winnowing material, in particular with a rib size of more than 2 mm. In this respect, it should be pointed out that tobacco materials such as raw ribs, winnowings, short stems or stem fibres but also scraps (small leaf tobacco particles), other tobacco small pieces, tobacco dust or a mixture of the of components listed above may be used.

The method proposed by the invention for producing cut tobacco is based on the following steps. A tobacco starting material is heated and brought to a first increased pressure in one method stage. In a subsequent method stage, the tobacco material is then pumped to a second increased pressure which is higher than the first increased pressure, and finally the tobacco material, heated and placed under pressure, is expanded and fed through a forming tool.

The pumping process helps to increase the pressure significantly (figures given below are above atmospheric pressure) prior to being expanded and passing through the forming tool, thereby obtaining optimum process conditions for producing a product of even better quality. Very high pressures can be generated which can not be achieved with the apparatus known from the prior art and mentioned above (screw conveyors) and amongst other things, this affords a high degree of freedom as regards the choice of forming tool. Furthermore, an operating mode which creates little wear is possible. Details of the advantageous mechanisms proposed by the invention will be explained in detail below.

In one embodiment of the invention, the tobacco material is pumped to the second increased pressure without essentially increasing the temperature of the material. A pumping process permits such an approach.

In one embodiment of the invention, the tobacco starting material is heated to a temperature of 60 to 180° C., in particular 100 to 140° C., and brought to a pressure of 10 to 200 bar, in particular 1 to 100 bar, more especially 1 to 50 bar, during the first stage of the method. During the second stage of the method, a pressure of 100 to 700 bar is achieved as a result of this invention, in particular 200 to 700 bar and more especially more than 200 bar to 700 bar.

The tobacco material is expanded to atmospheric pressure as it passes through the forming tool and this takes place in particular by a controlled flash evaporation.

During the second stage, the tobacco material may be fed through a positive displacement pump, in particular a gear pump.

As it passes through the forming tool, the tobacco material is advantageously formed to a fibre shape, in particular reduced to fibres, and the forming tool may be an outlet gap, a shearing gap, a die or a nozzle, for example. Due to the conditions of the method which can be achieved by pumping to the second raised pressure, the risk of blockages can be avoided and a freer choice of tools is available, which is a major advantage because the shape to be imparted to the tobacco material can also be selected more freely.

During the first method stage, the tobacco starting material is placed under pressure by mechanical means in particular, especially by means of a conveyor screw or stuffing screw, which presses the material against the outlet of a screw conveyor, in particular one which can be heated.

After further processing, the tobacco material may be used directly for smoking article material, especially if the tobacco starting material is a winnowing material. However, it may also be subjected to a screening process, especially if the starting material is a coarse rib material. This being the case, the material separated out may be subjected to the method proposed by the invention again and the remainder which is not separated may be despatched directly for further processing as smoking material.

The device proposed by the invention for producing cut tobacco material has a pressure chamber, in particular one which can be heated, which has a tobacco material inlet, a tobacco material outlet and a conveyor mechanism for conveying the tobacco material from the inlet to the outlet and for raising the pressure of the material to a first increased pressure. It also has a forming tool, by means of which the tobacco material, heated and placed under pressure, is conveyed and expanded, and for the purpose of the invention, a mechanical pump is integrated between the pressure chamber and the forming tool which pumps the tobacco material to a second increased pressure which is higher than the first increased pressure.

The advantages which can be achieved by the device proposed by the invention are the same as those mentioned above in respect of the method proposed by the invention.

The mechanical pump may be a hydrostatic positive displacement pump, in particular a gear pump.

The forming tool is a tool which reduces the tobacco material to fibres, in particular cuts it to fibres, and it may specifically have an outlet gap, a shearing gap, a die or a nozzle.

In one embodiment of the invention, the pressure chamber forms or the pressure chamber comprises a heatable screw conveyor, in particular a stuffing screw, which serves as a conveyor mechanism for conveying the tobacco material from the inlet to the outlet.

The invention further relates to the use of a device of the type described above for producing fibre-shaped tobacco material, in particular for reducing tobacco material to fibres. Another embodiment relates to the use of such a device for producing fine-cut tobacco material, in particular for use in roll-your-own cigarettes. This invention further relates to one of the aforementioned uses, whereby a method of the type described above is implemented in various ways.

It should be pointed out that one or more of the following features may fall within the scope of the invention:

- the tobacco starting material is a coarse tobacco material, in particular with a particle size of more than 2 mm;
- the tobacco starting material is a tobacco rib material or a winnowing material, especially with a rib size of more than 2 mm;
- the tobacco starting material is processed without the addition of structure-forming materials foreign to tobacco;
- the dwell time of the tobacco material during continuous circulation is less than three minutes, in particular less than two minutes and preferably less than one minute;
- the material is coarsely pre-cut or pre-chopped to fibres in the pressure chamber as it is conveyed to the forming tool;
- if a shearing gap is used, it is clamped shut and is intermittently opened due to the pressure of the tobacco material or the tobacco material is fed through the shearing gap continuously;
- the shearing gap walls effect a relative movement (shearing motion) as the tobacco material passes through;
- before or during heating and generating pressure in the first method stage, a tobacco material conditioning process or casing takes place, thereby increasing the material moisture content from 9 to 12% to approximately 20 to 30%
- after expansion and having passed through the forming tool, the tobacco material has a moisture content of approximately 14 to 18%;
- the tobacco material is cooled at room temperature and at atmospheric pressure until it has a moisture content of approximately 12 to 16%;
- if a shearing gap is used, the gap walls have a rough texture or profiling;
- the stuffing screw has steeper screw pitches towards the region of the outlet; and
- a pressure conditioning system, in particular a screw chamber-pressure conditioning system, is connected upstream of the device proposed by the invention, either in the same pressure chamber housing or one connected upstream.

Figure 2:
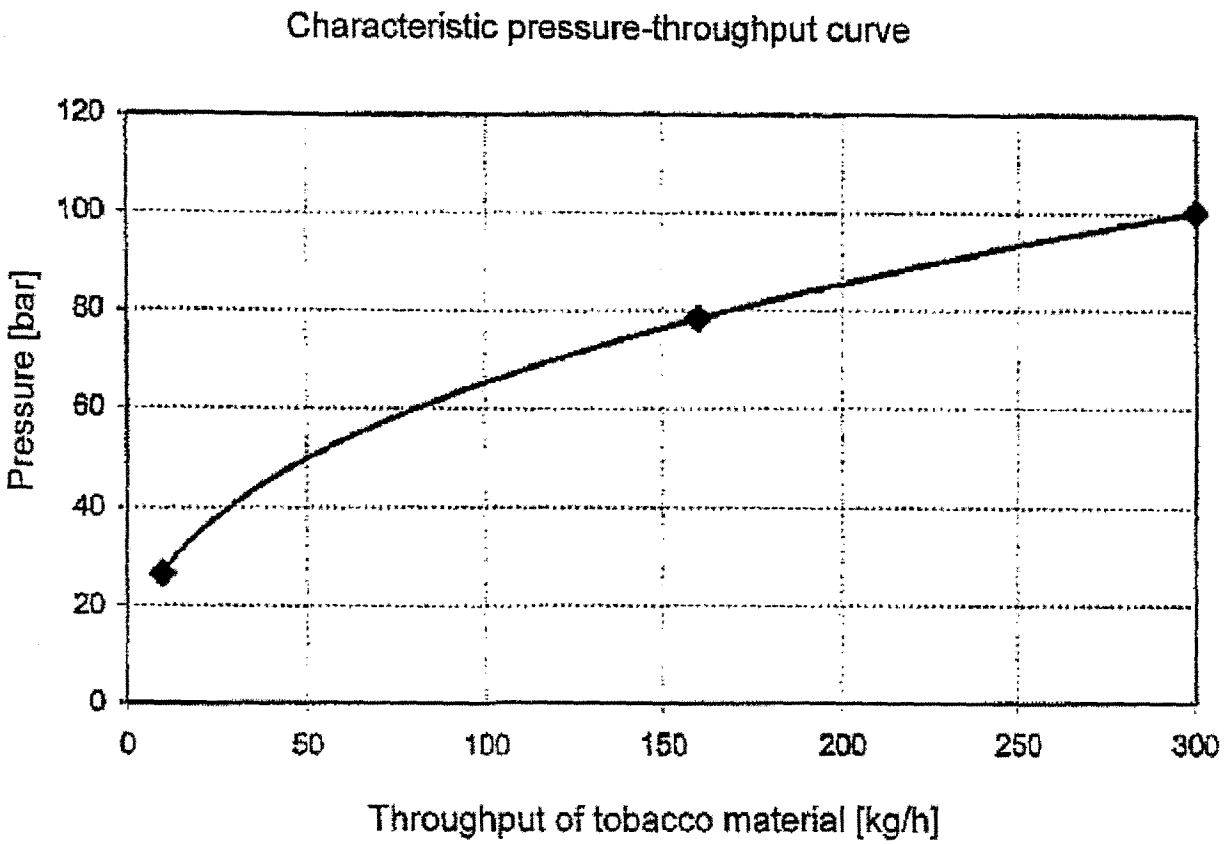
Figure 3:
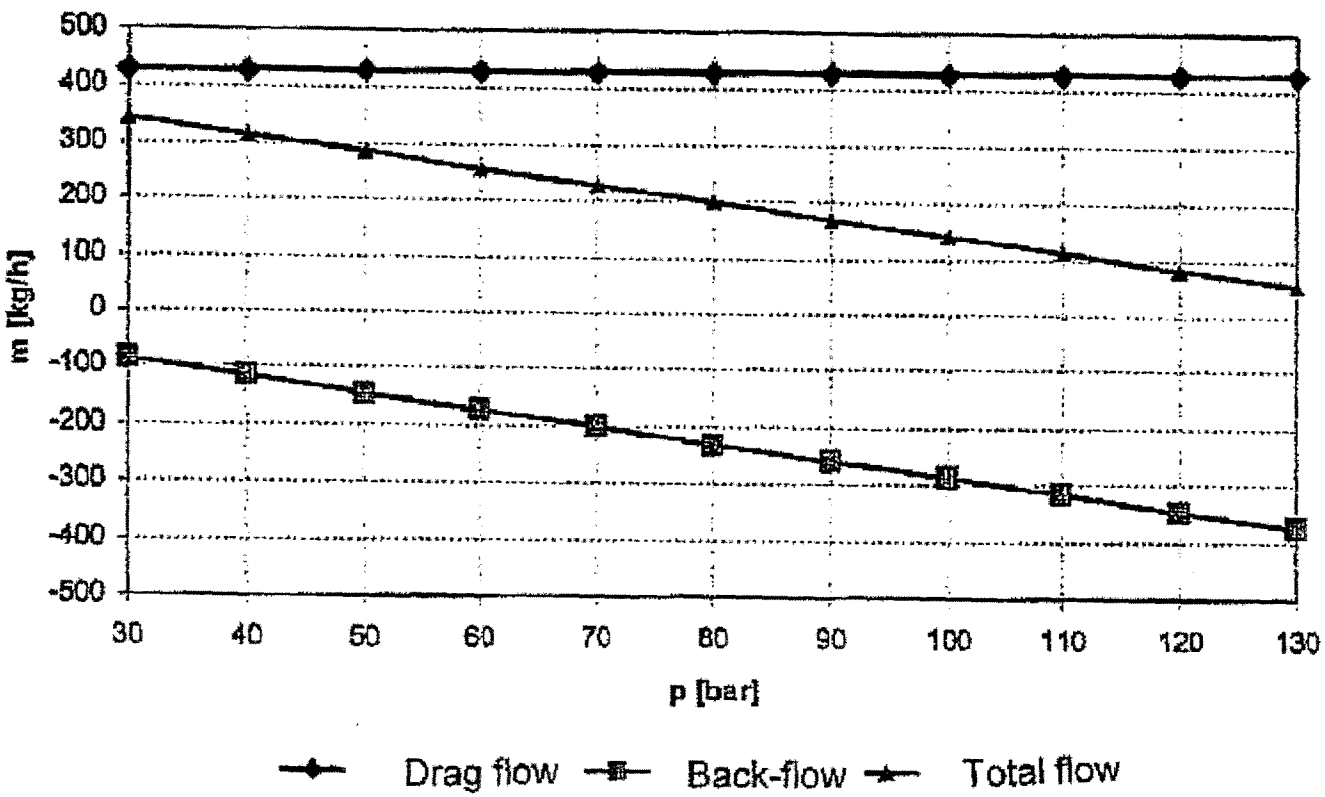
Figure 4:
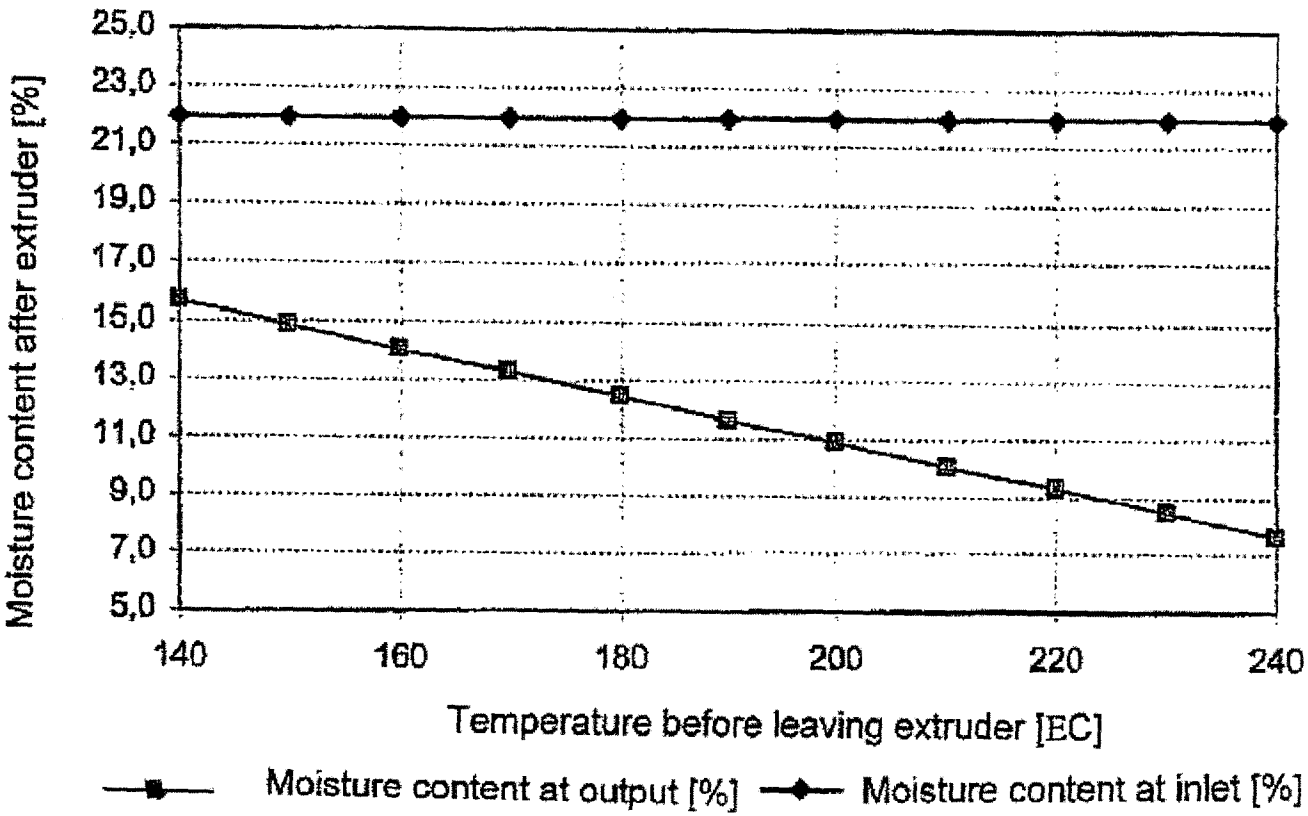
Figure 5:
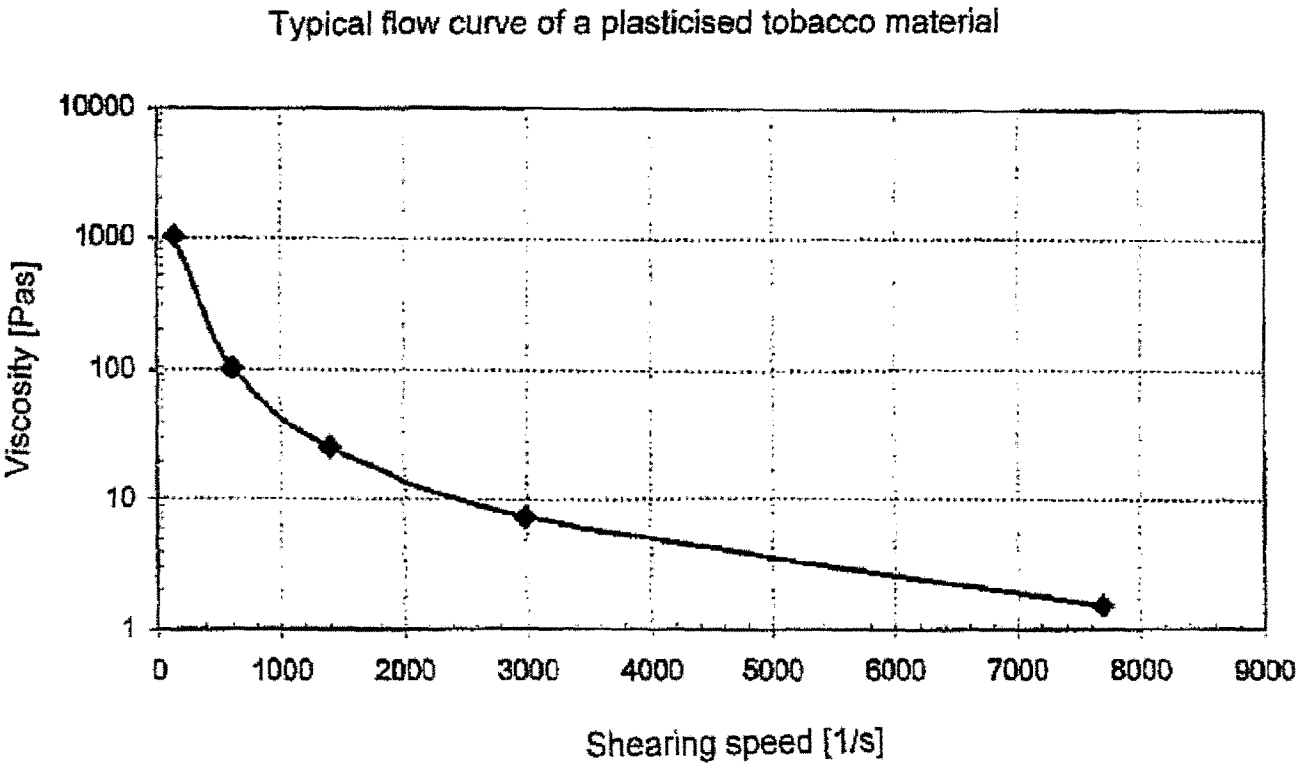

The invention will now be explained in more detail with reference to theoretical considerations and with the aid of an example of an embodiment. It may incorporate all of the feature described here, either individually or in any practical combination. The appended drawings illustrate the following:

FIG. 1 A device proposed by the invention for producing cut tobacco material;

FIG. 2 a characteristic pressure-throughput curve for a forming tool;

FIG. 3 a diagram of the mass flow through a screw conveyor due to pressure, in which different parts of the flow are highlighted;

FIG. 4 a curve plotting the moisture content of the tobacco material after leaving a screw conveyor (extruder) as a function of the temperature before leaving the extruder;

FIG. 5 a typical flow curve of a plasticised tobacco material; and

Figure 6:
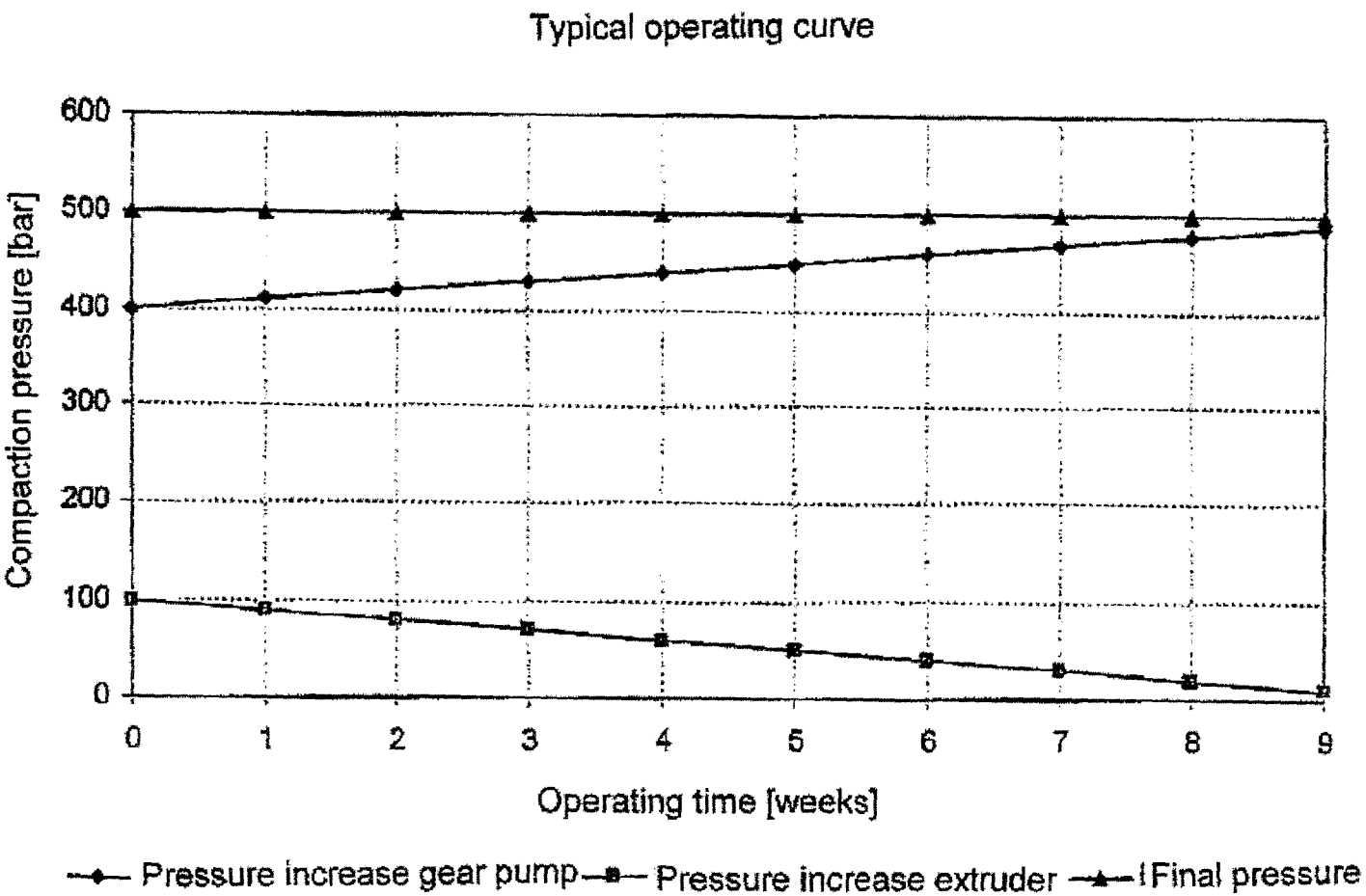

FIG. 6 a typical operating curve (compaction pressure and operating time) for an embodiment of the device proposed by this invention.

The inventive device illustrated in FIG. 1 has a screw conveyor denoted by reference number 1. The screw conveyor has a conveyor screw 5 which is mounted on a shaft 3 and accommodated in a housing 2 (pressure chamber). In one example of an embodiment, tobacco ribs are fed into the screw conveyor 1 and conveyed through the screw 5, namely to the left towards the outlet 6 of the screw conveyor 1. As this happens, the conditioned rib material is pre-cut and mechanically brought to an increased pressure at the outlet, which may be up to 200 bar.

Adjoining the outlet 6 of the screw conveyor 1 is the gear pump 7, which in this example is a hydrostatic positive displacement pump. The rib material firstly passes through the inlet 8 provided in the housing 9 into the pump 7 and is then conveyed onward by the two pump-gears 11 and 13 and compressed. The compression, i.e. the increase in pressure, takes place due to the spaces between gears, which become smaller, thereby resulting in tobacco material that is highly compressed or at a very high pressure (second increased pressure) at the pump outlet 10. The pressures at the pump outlet 10 and at the pump inlet 8 are measured and are checked by pressure sensors 17 and 15 respectively. The operating mode of the pump can be set in order to influence these pressures and make a correction if necessary.

From the pump outlet 1, the tobacco material passes into a forming tool, which is denoted by reference number 23 in FIG. 1. It comprises an inner cone 19 which is static and an outer cone 21 which is static but is mounted so that it can also be axially displaced. The inner cone 19 and the outer cone 21 of the tool form a gap 25 through which the tobacco material is able to leave the device under the high pressure, being expanded due to a flash evaporation and assuming the desired fibre structure of the material.

The invention therefore relates to the cutting into fibres (reducing to fibres) and re-forming of tobacco material—as implemented on the device described above—in order to impart a fibre shape to tobacco particles. The process is distinctive due to a particularly low-wear operating mode and increased process flexibility. Tobacco coarse parts are cut, optionally together with small or very small particles already in or added to the starting material as required, formed in the tool and discharged as fibres. Of particular advantage is the robustness of such an apparatus in terms of the properties of the material to be processed which cause wear, especially because there are no restrictions as to the choice of formula. The tobacco material produced by a method and a device as proposed by the invention can be used directly for the production of smoking articles; in form and colour, it is no different from cut tobacco. The invention can therefore be used in conjunction with the production of smoking article products for self-prepared cigarettes (also referred to below as Roll-Your-Own products (RYO) or Make-Your-Own products (MYO)) with a short cut width, because the tool is flexible and in particular it is also possible to use tools with very small passages which can be used at particularly high pressures.

Amongst other things, the invention is based on the following considerations.

Known methods such as that disclosed in patent specification DE 10 2004 059 388 A1 mentioned above, for example, do not allow pressures to be generated, at least not directly, such as those that are actually desirable for producing an optimised tobacco material. This is attributable—as observed during the work done on this invention—firstly to the fact that an increase in pressure is accompanied by an increase in temperature due to the higher shearing energy generated, the degree of which is determined by the material and screw conveyor. Secondly, the design of the predefined tool is determined by the preliminary pressure because the drop in pressure—defined by the free tool cross-section—and the mass flow of the tobacco materials are proportionately correlated, as demonstrated in FIG. 2 for example. In order to form tobacco structures which meet the highest quality demands, for example RYO or MYO tobacco structures, a very high tool preliminary pressure is needed (chamber pressure of the screw conveyor) because the shearing gaps must have very small cross-sections. This applies to the situation where only one screw conveyor and one adjoining shearing gap tool is used for example. In order to be able to operate at the same mass flows, the chamber pressure must be increased significantly, as may be seen from FIG. 2.

In principle, such pressure can not be applied by a screw conveyor (extruder). One reason for this is that the so-called back-flow (sum of the pressure flow and leakage flow), dominates the drag flow, as illustrated in FIG. 3, and would therefore halt the conveying action. However, in view of the construction design, such a back-flow can not be avoided. However, the ratio of product back-flow to product conveyance is essentially influenced by the requisite pressure at the chamber outlet, the wear pattern of the device (screw) affecting the flow through the shearing passage and the relevant material properties of the tobacco material (viscosity).

Another problem resides in the energy generated by shearing which accompanies the conveying action and the associated increase in the temperature of the material being conveyed. If temperatures up to 200° C. and compaction up to 200 bar is reached with conventional devices, the product can already be damaged. The anticipated high product temperature at even higher pressures would cause structural damage after an isenthalpic pressure release based on the principle of capacitive drying) on leaving the tool due to the development of water vapour and would also lead to complete over-drying, which is not desired. This relationship is illustrated in FIG. 4. However, over-dried products tend to cause counter-productive dust formation due to the brittleness properties.

Due to the very low coefficient of heat throughput, cooling between a cooling medium and the product flow would barely be possible or would merely be of slight assistance so that it must be concluded, all in all, that the conventional system with the screw conveyor is not suitable for generating a chamber pressure of up to 700 bar. Although lower preliminary pressures can be generated with a screw conveyor (200 bar or less), the range of parameters as regards the formulas, filling capacity or very small fibre diameter to be obtained is limited. Using a pump (in particular a mechanical pump) to generate the second increased pressure overcomes the above problems and enables the production of optimised products at economically acceptable mass flows and in particular with a low-wear operating mode. In the embodiment illustrated, such a pump is the gear pump 7 and the screw conveyor 1 supplies this pump.

Gear pumps are hydrostatic positive displacement pumps and the conveying action is operated on the principle of a closed volume. As a result of this principle, very high pressures can be generated when conveying viscous masses with moderate rises in temperature. The material should be fed to the pump assisted by a (slight) pressure, thereby enabling a 100% filling level to be achieved, and a screw conveyor lends itself very well to generating this preliminary pressure.

Like liquids, fluid materials such as pastes, pulps, doughs, can be characterised on the basis of viscosity. Tobacco materials are solids but pseudo-plastic flow properties are imparted to them after adding water, an increase in temperature and shearing, and they can therefore be conveyed in a positive displacement pump. These basic flow properties are created in the screw conveyor. A typical flow curve of a plasticised tobacco material may be seen in FIG. 5 and the invention therefore uses this pseudo-viscosity in order to convey the material and place it under pressure, even though a homogeneous pulp is not actually created as would be the case with tobacco leaf production, for example.

The tool 23 illustrated in FIG. 1 has gap walls which can be moved towards and away from one another in the axial direction, which form a shearing gap. The two tool parts (inner cone 19 and outer cone 21) are biased towards one another and the profiling indicated in the drawing constitutes the principle by which the tobacco fibres forming around the circumference are shaped and influenced. Although the two tool parts can be rotated towards one another (as is the case with the prior art described in DE 10 2004 059 388 A1), this is surprisingly not necessary. With this knowledge, it is possible for the first time to use dies, static nozzles and similar as the tool because the feared blocking and hence associated rises in pressure (reduction of the free cross-sections) can be controlled.

Due to the fact that compression takes place almost without any rise in temperature, the operating temperature and working pressure are effectively separate parameters. Accordingly, operating temperatures of 60 to 180° C., which have already been found to be of advantage, can be easily set in conjunction with final pressures of 200 to 700 bar, thereby avoiding any fear of the fibres being destroyed due to too intensive development of steam. It should also be pointed out that the specified rating of a pump or a positive displacement pump will also be lower due to the low increase in temperature.

Due to the high compaction of the tobacco material, the tobacco density is naturally increased. However, the controlled flash evaporation which occurs on expansion to atmospheric pressure reverses the compaction and leads to a loose cut tobacco. Surprisingly, this expansion and the restoration of the natural filling capacity is still possible even with the unusually high degree of compaction of the tobacco material which occurs due to the invention.

The combination of screw conveyor and pump, in particular a positive displacement pump, can also help to compensate for unavoidable wear. As already explained, the conveying behaviour of the screw conveyor is dependent on the state of wear, the final pressure and the properties of the material. Due to the proposed inventive design, it is possible to distribute the pressure needed to induce a flow through the tool differently between the screw conveyor and positive displacement pump. If the wear pattern becomes worse, the final pressure of the screw conveyor can be reduced, for example, in which case the positive displacement pump then automatically supplies the increase in pressure needed to induce a flow through the tool. Such behaviour is plotted in the operating curve shown in FIG. 6. The measurements of the sensors 15, 17 illustrated in FIG. 1 are also used for this purpose.

Further evidence of the positive effects of this invention as regards operating the device and the mass flow will become apparent below from the explanation of the tests that were conducted:

Test 1:

In this test, the effect on wear of the different pressure distribution (screw conveyor/gear pump) and the same final end pressure were studied. A formula, based on 70% winnowings+30% tobacco dust is treated in the apparatus illustrated in FIG. 1 using the following parameters:

| Measurement | | Comparison | Test 1 |
|---|---|---|---|
| Process | | | |
| Moisture content at inlet | [%] | 22 | 22 |
| Moisture content at outlet | [%] | 15 | 17 |
| Final pressure screw conveyor | [bar] | 80 | 10 |
| Final pressure gear pump | [bar] | 120 | 120 |
| Temperature screw conveyor outlet | [° C.] | 140 | 100 |
| Temperature gear pump outlet | [° C.] | 150 | 110 |
| Mass flow | [kg/h] | 150 | 150 |
| Operating hours until conveying halted | [Hours] | 70 | 150 |
| Product | | | |
| Filling capacity corrected* (starting material) [ml/g] | | 2.5 | 2.5 |
| Filling capacity corrected* (finished material) [ml/g] | | 4.5 | 4.7 |

*Tobacco moisture content corrected during measuring

Results of Test 1:

Due to the low operating pressure and the lower operating temperature in the screw conveyor, the wear detected during the operating hours leading up to the point when conveying was halted was more or less halved. This resulted in a longer service life of the device. Naturally, the moisture content at the outlet due to the lower input of shearing energy was lower because the temperature load is lower.

Test 2:

During this test, increases in throughput and the associated pressure increase upstream of the forming tool were studied.

A formula based on 70% winnowings+30% tobacco dust is treated in the apparatus illustrated in FIG. 1 using the following parameters:

| Measurement | | Comparison | Test 2 |
|---|---|---|---|
| Process | | | |
| Moisture content at inlet | [%] | 22 | 22 |
| Moisture content at outlet | [%] | 15 | 15 |
| Final pressure screw conveyor | [bar] | 50 | 50 |
| Final pressure pump | [bar] | 120 | 200 |
| Temperature screw conveyor outlet | [° C.] | 140 | 140 |
| Temperature gear pump outlet | [° C.] | 150 | 150 |
| Mass flow | [kg/h] | 150 | 250 |
| Product | | | |
| Filling capacity corrected* (starting material) [ml/g] | | 2.5 | 2.5 |
| Filling capacity corrected* (finished material) [ml/g] | | 4.5 | 4.5 |

*Tobacco moisture content corrected during measuring

Results of Test 2:

Due to the additional pressure applied by the gear pump proposed by the invention, the mass flow was increased by approximately 60%, thereby increasing economic viability.

The invention claimed is:

1. A method of producing cut tobacco material, comprising:

heating and pressurizing a tobacco starting material to a first increased pressure in a first stage: and pumping, in a subsequent stage, the tobacco material to a second increased pressure which is higher than the first increased pressure, wherein the heated and pressurized tobacco material is expanded and fed through a forming tool.

2. The method of claim 1, wherein the tobacco material is pumped to the second increased pressure without substantially increasing the temperature of the material.

3. The method of claim 1, wherein the tobacco starting material is heated to a temperature of 60 to 180°C. and brought to a pressure of 1 to 200 bar during the first stage.

4. The method of claim 1, wherein the tobacco starting material is brought to a pressure of 100 to 700 bar during the subsequent stage.

5. The method of claim 1, wherein the tobacco material is expanded to atmospheric pressure as it passes through the forming tool.

6. The method of claim 1, wherein the tobacco material is conveyed by means of a displacement pump during the subsequent stage.

7. The method of claim 1, wherein the tobacco material is formed into a fibre shape as it passes through the forming tool.

8. The method of claim 1, wherein the tobacco material is fed through an outlet gap serving as the forming tool.

9. The method of claim 1, wherein the tobacco starting material is mechanically placed under pressure during the first stage.

10. The method of claim 1, wherein the cut tobacco material reduced to fibres by pressure is despatched directly for further processing as a smoking article material, or is subjected to a screening process, wherein the materials separated out during screening are subjected to the method once more and the remainder that is not separated out is despatched directly for further processing as a smoking article material.

11. The method of claim 3, wherein the tobacco starting material is heated to a temperature of 100 to 140°C.

12. The method of claim 11, wherein the tobacco starting material is heated to a temperature of 110 to 130°C.

13. The method of claim 3, wherein the tobacco starting material is brought to a pressure of 1 to 100 bar during the first stage.

14. The method of claim 13, wherein the tobacco starting material is brought to a pressure of 1 to 50 bar during the first stage.

15. The method of claim 4, wherein the tobacco starting material is brought to a pressure of 200 to 700 bar during the subsequent stage.

16. The method of claim 4, wherein the tobacco starting material is brought to a pressure of more than 200 bar to 700 bar during the subsequent stage.

17. The method of claim 1, further comprising:

expanding the tobacco material to atmospheric pressure via controlled flash evaporation as it passes through the forming tool.

18. The method of claim 1, wherein the tobacco material is conveyed by means of a gear pump during the subsequent stage.

19. The method of claim 1, wherein the tobacco material is cut to fibres as it passes through the forming tool.

20. The method of claim 9, further comprising:

placing the tobacco starting material under pressure during the first stage via one of a conveyor screw or a stuffing screw, and pressing the material via one of the conveyor screw or the stuffing screw against the outlet of a heatable screw conveyor.

21. The method of claim 1, wherein the tobacco material is fed through one of a shearing gap, a die or a nozzle.

* * * * *